United States Patent [19]

Tsujimoto et al.

[11] 4,258,731

[45] Mar. 31, 1981

[54] HAIR WAVING APPLIANCE CONTROLLED BY A MICROCOMPUTER

[75] Inventors: Susumu Tsujimoto, Fujiidera; Hayao Yamazaki, Nara; Masayoshi Ozaki, Kawachinagano; Takehiro Kobayashi, Sakai; Toru Fujino, Neyagawa; Mitsuo Yasuda, Tenri; Katsuji Minami, Osaka; Zirou Itogawa, Takaishi, all of Japan

[73] Assignee: Sharp Kabushiki Kaisha, Osaka, Japan

[21] Appl. No.: 29,693

[22] Filed: Apr. 13, 1979

[30] Foreign Application Priority Data

Apr. 14, 1978 [JP] Japan ..... 53/44625

[51] Int. Cl.[3] ..... A45D 20/00

[52] U.S. Cl. ..... 132/9

[58] Field of Search ..... 132/9, 8; 34/88, 89, 34/96, 97; 219/364

[56] References Cited

U.S. PATENT DOCUMENTS

| | | | |
|---|---|---|---|
| 2,289,209 | 7/1942 | Reiches | 132/9 |
| 3,044,473 | 7/1962 | Cover | 132/9 |
| 3,303,325 | 2/1967 | Hubrich | 34/96 X |
| 3,550,285 | 12/1970 | Omohundro | 34/97 |
| 3,575,181 | 4/1971 | Rudd | 132/9 |
| 3,978,314 | 8/1976 | Shimizu | 34/97 |
| 4,085,309 | 4/1978 | Godel | 34/97 |
| 4,114,022 | 9/1978 | Braulke | 34/97 |
| 4,167,820 | 9/1979 | de Groot | 34/97 |

*Primary Examiner*—G. E. McNeill

*Attorney, Agent, or Firm*—Birch, Stewart, Kolasch & Birch

[57] ABSTRACT

A heating type hair waving appliance includes a bonnet in which the hairline area of the head of a patron is inserted and a plurality of infrared radiation lamps serving as a source of heat for heating the hairline area. A controller is implemented with a microcomputer semiconductor integrated circuit for receiving inputs applied via an input keyboard and placing the plurality of the infrared lamps into predetermined conditions. A solid state display provides a display of the operative state of the infrared lamps and an ultrasonic type atomizer is provided for generating moisture-laden mist which in turn is guided into the interior of the bonnet.

10 Claims, 16 Drawing Figures

HAIR WAVING APPLIANCE CONTROLLED BY A MICROCOMPUTER

BACKGROUND OF THE INVENTION

This invention relates to an improvement in a heating type hair waving appliance.

A conventional way to confer a durable hair wave is to allow a waving agent to react on hair at room temperature. This is called "cold waving". However, in this instance the waving agent, for example, thioglycolate must be strong in order to react on hair at room temperature. Thus, there is a great risk that the waving agent will damage the skin of a beautician and the hair of a patron. In addition, since the period where the waving agent reacts on the hair is determined primarily by feeling and the experiences of a beautician, the degree of hair waving occasionally is too much or too little.

Lately, some approaches to overcome the defects noted above have been suggested, for example, heating types of a hair waving appliances have been used wherein hair is heated before the reaction of a waving agent. One method of waving hair involves curling the hair about heat-accumulated curler rods to heat the hair and allowing a waving agent to react on the hair. An alternative method of waving hair involves supplying hot air to waving agent laden hair to heat the same during the reaction of the waving agent.

Both methods were effective for allowing a decrease in the intensity of the waving agent. However in, the former heated wave method it was difficult to maintain the reaction of the waving agent at the optimum temperature and adjust the reaction period because the temperature of the curler rods falls quickly, while in the latter heated wave method there is the likehood of drying the waving agent out by hot air prior to the reaction of the waving agent.

SUMMARY OF THE INVENTION

Accordingly, the present invention overcomes the disadvantages noted with the above outlined prior art by providing an improved hair waving appliance of the invention.

Pursuant to one preferred form of the present invention, a hair waving appliance comprises a bonnet in which the hairline regions of the head of a patron are inserted, a heating means disposed in the bonnet for heating the hairline regions, a controlling means for receiving inputs applied via an input means and placing said heating means into a predetermined operative state and a display means for displaying the operative state of the heating means controlled by said controlling means.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figures 1, 3:
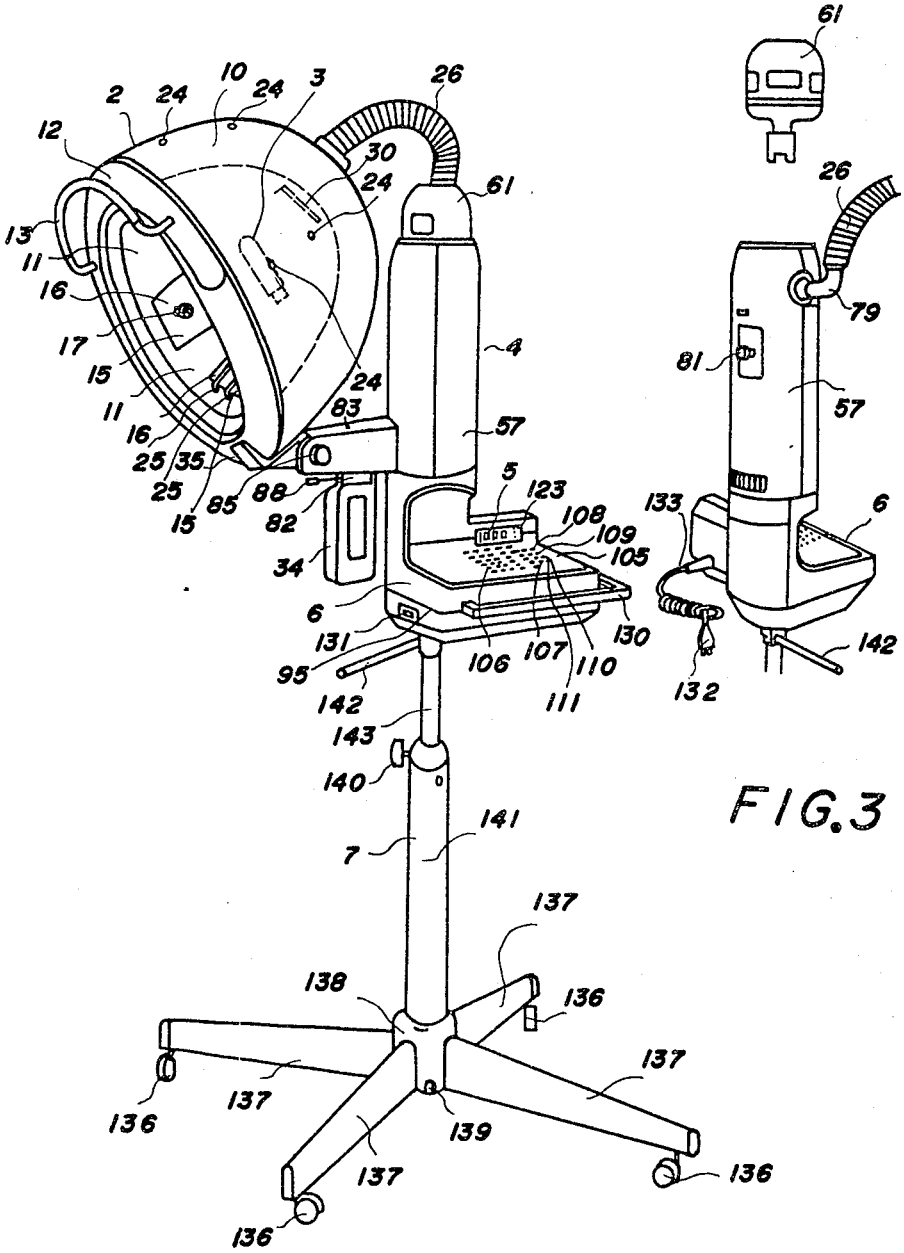
FIG. 1 is a perspective view of a permanent waving appliance according to the present invention.
FIG. 3 is a rear view of the appliance of FIG. 1.

Referring now to FIG. 1, there is illustrated a heating type hair waving appliance according to one preferred embodiment of the present invention. This embodiment includes a bonnet 2 in which the hairline regions 1 of the head of a patron is inserted, a heater 3 disposed within the bonnet 2 for heating the hair line regions of the patron's head and an atomizer assembly 4 for generating mist at room temperature for the hair line region 1 within the bonnet 2. A controller 6 controls the heating temperature and heating duration of the heater 3 and the operational condition of the atomizer assembly 4 and contains a display 5 for displaying the heating temperature and heating duration of the heater 3. The bonnet 2 is adjustable in angle of elevation and the atomizer assembly 4 is rotatable in a limited range. The controller 6 is rotatable independently of the atomizer assembly 4. The bonnet 2, the atomizer assembly 4 and the controller 6 are secured at proper levels on a prop 7.

The bonnet 1 has an outer shell 10 and an inner shell 11 both of which are held in a spaced relationship by means of a bonnet ring 12. The bonnet ring 12 is provided with a handle 13 for adjusting the angle of elevation of the bonnet 1.

A ring-shaped water collector slit 14 is formed for collecting water drops on the inner wall of the bonnet 11. The bonnet 11 has radiation windows 16 each corresponding to a respective one of divided hairline regions, for example, five regions; a front hairline region 1*a*, a top hairline region 1*b*, a rear hairline region 1*c*, a left side hairline region 1*d* and a right side hairline region 1*e*. The respective radiation windows 16 are overlaid with window plates 15 of heat proof plastic material. Temperature sensors 17 are provided at the radiation windows 16 to monitor the temperatures of the respective hairline regions 1*a* through 1*e*. The heater 3 has one or two infrared lamps 19 for each of the hairline regions, the infrared lamps being located in the radiation windows. Reflectors 20 are removably provided for the respective heating elements 3 for collecting and reflecting heat from the respective heating elements 3. Pilot lamps 24 are secured through small apertures 22, 23 in the reflectors 20 and the outer shell 11 for displaying the operative conditions of the heating elements. Wired guards 25 are secured longitudinally across the radiation windows 16 in the bonnet 11. An atomizer tube 28 having a joint 27 leading to a hose 26 from the atomizer assembly 4 extends between the outer shell 10 and the inner shell 11. A distributor 30 is located at an outlet 29 of the atomizer tube 28 to distribute mist from the outlet 29 throughout the interior of the bonnet 11. A water collector wall 31 of a ring shape is established to collect drain water flowing out when the mist strikes the distributor 30. The collector wall 31 is led to one end of a drain hose 32 which is interposed between the outer shell 10 and the inner shell 11. The other end of the drain hose 32 is located in a drain water collector 33 in the bonnet ring 12. The drain water flowing along the distributor 30 and that flowing along the inner wall of the inner shell 11 are centered into the collector 33 leading to one end of a drain water conduit 36 of a neck piece 35 and to a drain water tank 34. The bonnet piece 35 holding the bonnet 2 is affixed to the bonnet ring 12.

The temperature detecting sensor 17, as indicated in FIGS. 7 through 11, comprises a temperature sensitive element 37 such as a thermistor and a plastic mold sensor body 46. The sensor body 46 includes a joint 39 between the temperature sensitive element 37 and lead wires 38, a fitting memeber 40, a hemishere portion 42 having a predetermined number of holes 41, reinforcing strings 44 of heat proof nylon or the like, and a metallic spring 43 secured aroung the body 46. Joints between the sensor body 46 and the sping 43 are covered with an adhesive for protecting the temperature sensor 17 against a waving agent, the mist, etc. Another hemisphere portion 49 having a plurality of holes 48 is fitted into the member 40 of the hemisphere portion 42 and both the hemisphere portions 42, 29 are bonded together by the use of an adhesive.

Figure 13:
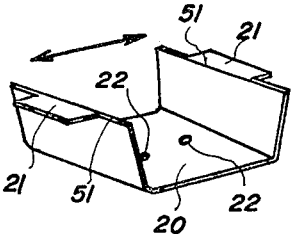
FIG. 13 is a perspective view of a reflector shown in FIG. 2.
Figure 15:
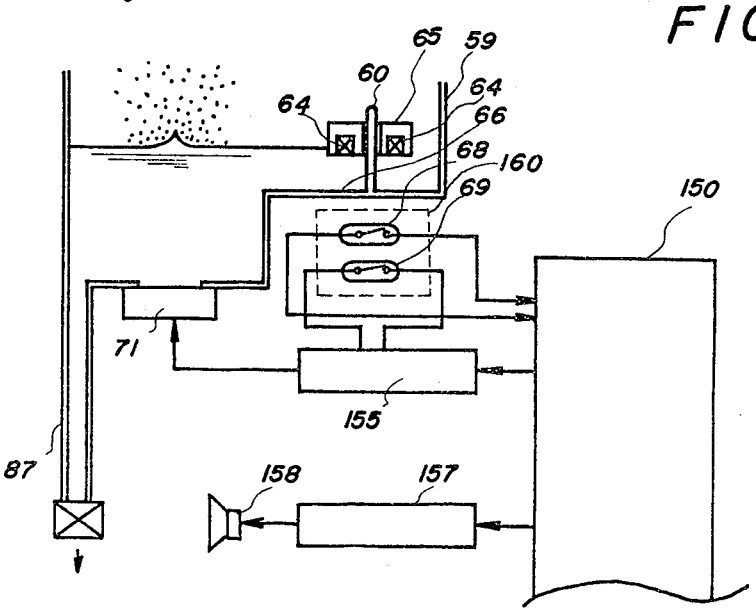
FIG. 15 is a schematic representation of a water level sensor in the heating type hair waving appliance.

The temperature sensor 17 is provided one for each radiation window 16. The reinforcing strings 44 are tied up on the radiation windows 16 or its frames 50, protecting the lfead wires 38 from an excessive tensile load exerted upon the temperature sensors 17. The reflector 20, as best seen from FIG. 13, a "U" shaped metallic plate with some elasticity and an engage member 21 to be fitted into a receiving member 52 in the radiation window frame 50 for the installation of the reflector 20 on the frame 50.

The atomizer assembly 4 has a housing 57 consisting of two separate members 55, 56, one of which carried an angle holding a fan motor and a power supply transformer. A liquid reservoir 59 is mounted above the atomizer housing 57, which has a guide pin 60 and a protrusion 63 serving to open a feed water valve 62 in contacting the valve 62. Below the guide pin 60 of the liquid reservoir 59 there is provided a float 65 carrying a magnet 64 slidable in a vertical direction. An angle 67 is located at the bottom 66 of the reservoir 59 in a position to correspond to the magnet 64 in the float 65. A printed circuit board 70 on which a first lead switch 68 and a second lead switch 69 are mounted in a stepwise fashion in located on the angle 67. It should be noted that operation of the second lead switch 69 is delayed with respect to that of the first switch 68.

Figure 2:
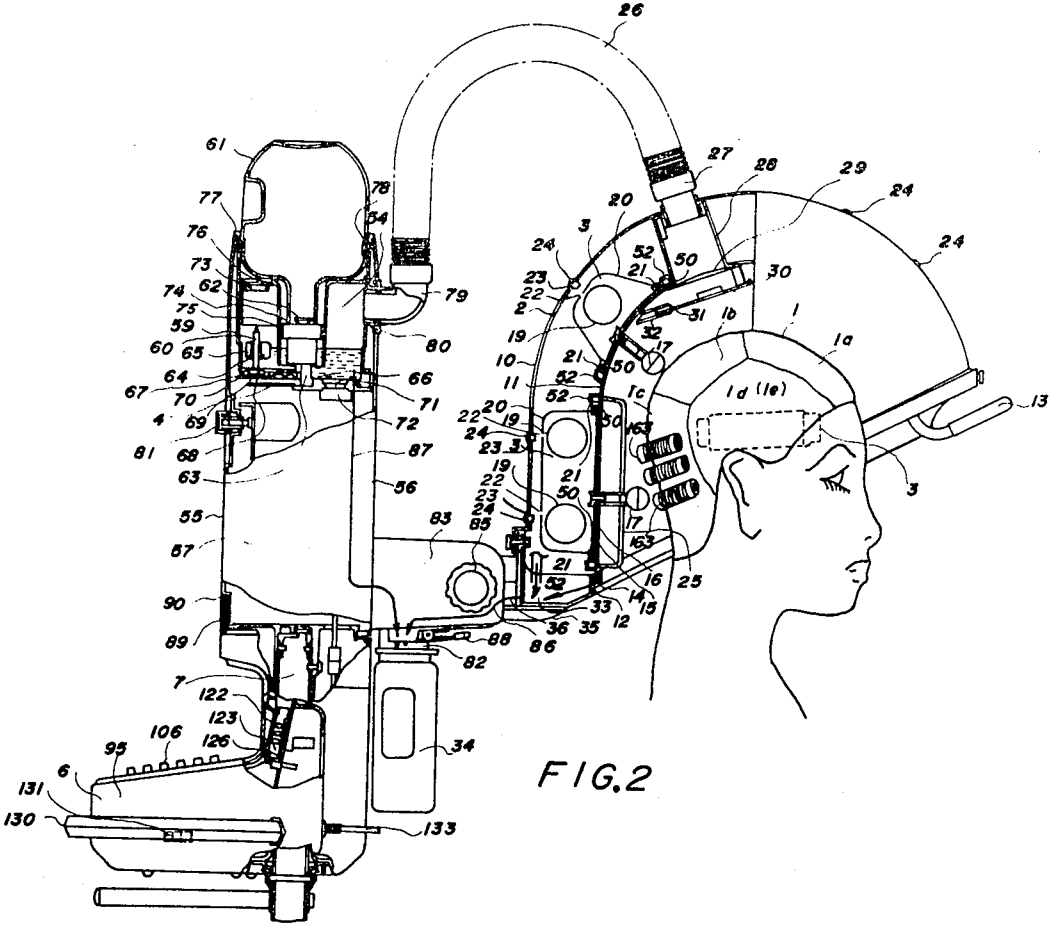
FIG. 2 is an enlarged cross sectional view of FIG. 1.

The atomizer assembly 72 is of the ultrasonic type and is located on the bottom 66 of the reservoir 59 such that an ultrasonic vibrator 71 is at the lowest level on the bottom 66 of the reservoir 59. An air intake is formed in the upper portion of the reservoir 59 for sending air from the fan motor to the interior of the reservoir 59. A ventilation 73 is also formed in the upper portion of the reservoir 59 for collecting the air via the above described air intake. A reservoir lid 76 having a cylinder 75 is provided for preventing the liquid level in the reservoir 59 from vibrating, the cylinder 75 running through a feed water conduit 74 leading to a feed water tank 61. At the upper end of the reservoir 59 there is provided an engaging member 77 positioned to cover the upper end of the atomizer housing 57. A packing 78 is interposed between the feed water tank 61 and the reservoir 59. In order to send the mist from the ultrasonic type atomizer assembly 72 to the bonnet 2 by a blow from the fan motor, an "L" shaped joint 79 is affixed via a packing 80 to the atomizer housing 57. A bellows-shaped flexible atomizer hose 26 is connected between the "L" shaped joint 79 and the joint 27 on the bonnet 2. An atomizer switch 81 is provided for controlling operation of the ultrasonix atomizer assembly 72 and the amount of the mist. An arm 83 is secured below the atomizer housing 57 to hold the bonnet 2 rotatabily and the drain water tank 34 removably via a fastening member 82. The neck piece 35 of the bonnet 2 on the arm 83 is rotatable and adjustable in angle of elevation by the use of an adjustment knob 85. The drain water tank 34 is attachable and removable thereon. A drain water passageway 86 (as denoted by the solid line arrow in FIG. 2) is formed in the arm 83 to lead the drain water from the drain water passageway 36 (as denoted by the solid state arrow in FIG. 2) to the drain water tank 34. A drain water hose 87 (FIG. 2) for the liquid within the reservoir 59 is interposed between the bottom of the reservoir 59 and the drain water tank 34. A drain water lever 88 is disposed on the arm 83 for leading the liquid in the reservoir 59 to the tank 34 via the hose 87. An air intake 90 bearing a filter 89 is located below the atomizer housing 57. The bottom of the atomizer housing 57 is secured rotatably within a given range on the upper end of the prop 7.

When the liquid in the reservoir 59 is below a predetermined level, the first lead switch 68 becomes operative to provide an alarm in response to the magnet 64 contained within the float 65. When the reservoir 59 runs out of liquid to be atomized, the second lead switch 69 becomes operative in response to the magnet 64 in the float 65, thereby stopping operation of the ultrasonic type atomizer assembly 72 at once.

Figure 4:
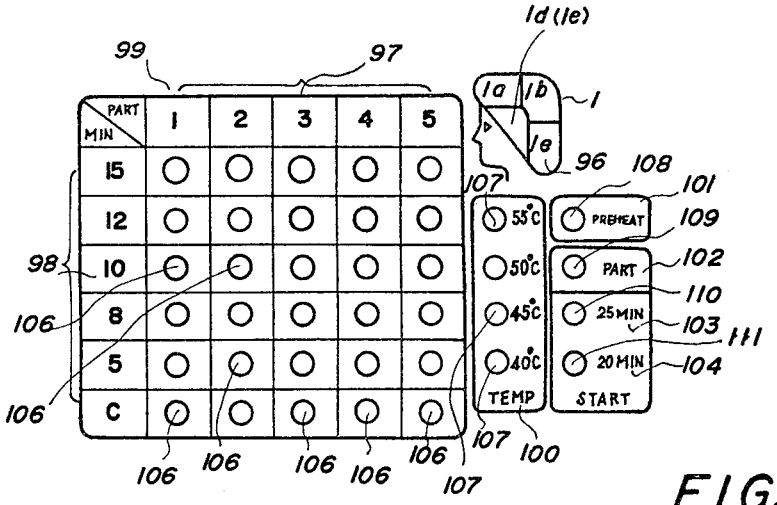
FIG. 4 is a representation of a panel shown in FIG. 1.
Figure 5:
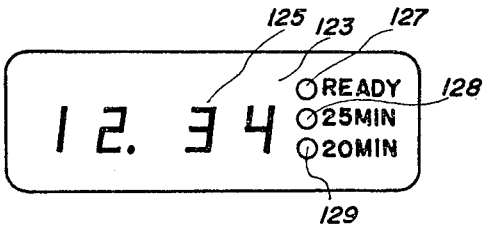
FIG. 5 is a representation of a display window shown in FIG. 1.
Figure 6:
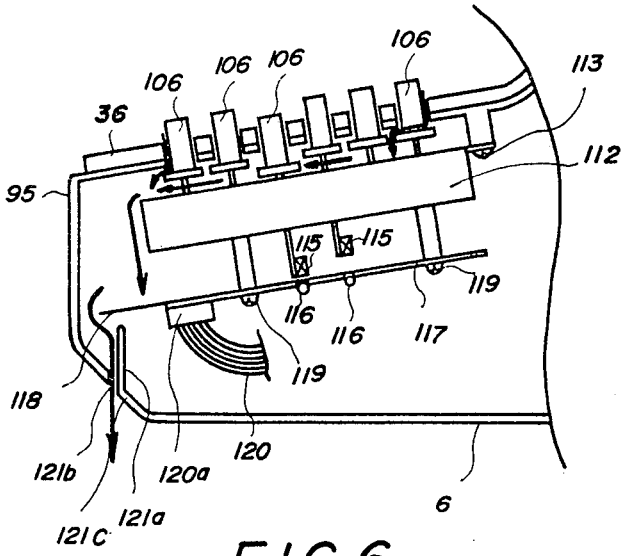
FIG. 6 is a cross sectional view of a controller shown in FIG. 1.
Figure 8:
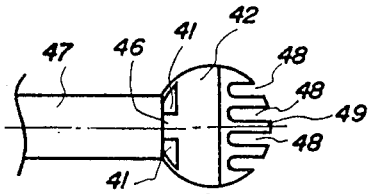
FIGS. 7 through 9 are a cross sectional view, a side view and a front view of a temperature sensor.
Figure 7:
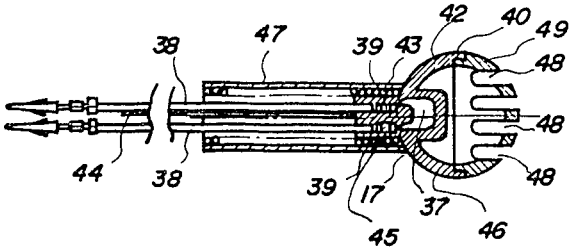
Figure 9:
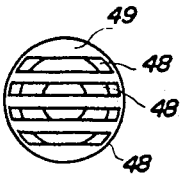
Figure 10:
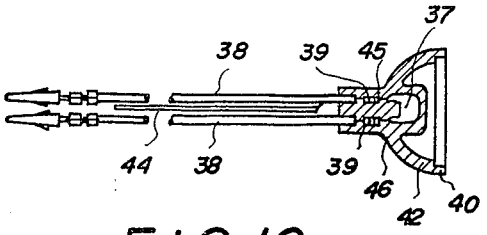
FIGS. 10 and 11 are representations showing the internal construction of the temperature sensor.
Figure 11:
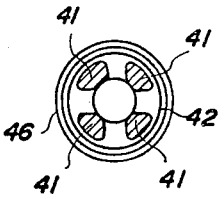
Figure 12:
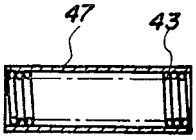
FIG. 12 is a cross sectional view of a spring shown in FIG. 10.

The controller 6 contains control circuitry that relies upon the micro computer technique within a housing 95. A panel 105 mounted on the top of the controller housing 95, as seen from FIG. 4, bears a display column 96 indicating the respective hairline regions, the front hairline region 1*a*, the top hairline region 1*b*, the rear hairline region 1*c*, the left side hairline region 1*d* and the right side hairline region 1*e*; a display column 97 indicating the positions of the respective hairline regions; a display column 98 indicating units of duration; a time display matrix 99; a display column 100 indicating temperature settings for the heater assembly 3; a display column 101 indicating a preheat key; a display column 102 indicating start keys for the respective hairline regions 1*a* through 1*e*; and display column 103, 104 indicating start keys for 25 min and 20 min operations. The control circuitry is controlled according to the time display 99 on the panel 105. A family of duration keys 106 is operated for setting heating durations of the heater device 3 according to the temperature setting display 100, thereby controlling the control circuitry. A family of temperature keys 107 is manually operated for setting heating temperatures of the heater device 3 according to the preheat key display 102, thereby introducing temperatures inputs to the control circuitry. The preheat key 108 is operated to control the control circuitry according to the start key display 102 on the panel 105. The start key 109 is actuated to control the control circuitry according to the 25 min and 20 min operation start displays 103, 104. A keyboard body 112 having the respective keys 106–111 inclusive of the 25 min operation start key 110 and the 20 min operation start key 111 is installed within the controller housing 95 by the use of screws 113 as indicated in FIG. 6. Within the keyboard body 112 there are provided a family of lead switches 116 on a printed circuit board 117, responsive to magnets 115 contained within the respective keys 106–111. A water proof sheet 118 is affixed to the keyboard side of the printed circuit board 117 via a screw 119. The printed circuit board 117 also carries a connector 120*a* having lead wires 120 communicating between the respective components on the board 117 and the microcomputer control circuitry. A drain water guide 121*a* and a drain water hole 121*b* are formed in a lower wall 121*c* of the controller housing 95 for discharging water drops on the sheet 118 to the outside of the controller housing 95. A display window 123 is provided in the top of the controller housing 95 together with a filter 122. A digital display 125, as shown in FIG. 5, is provided in the display window 123 for displaying the duration settings by the duration keys 106, the remaining durations and the preheating operation by a blinking zero. The digital display 125 is mounted on a board 126 within the controller housing 95. On the board 126 there are further provided a preheating display 127 of, for example, a green light emitting diode, and operation displays 128, 129 of, for example, red light emitting diodes for displaying the 25 min operation initiated by the start key 110 and the 20 min operation initiated by the start key 111. A "L" shaped handle 130 is provided for rotation of the controller housing 95. A power switch 131 is provided on the side wall of the controller housing 95. A power cord 133 having a connection plug 132 is attached to the rear wall of the housing 95. It will be noted that the controller 6 may be electrically separate from the atomizer assembly 4.

The prop 7 includes legs supported by casters 137 and a base 138. An earth terminal 139 is affixed to the base 138 and a sliding knob 140 is secured movably to a prop pipe 141. Within the prop pipe 141 a slide pipe 143 with a handle 143 is slidable in a vertical direction. The controller 6 is mounted rotatably on the slide pipe 143. The bottom 66 of the atomizer housing 57 is located at the upper end of the slide pipe 143 is settled at any desired level within the prop pipe 141. The slide pipe 143 is tightly affixed to the prop pipe 141 by fastening the knob 140.

Figure 14:
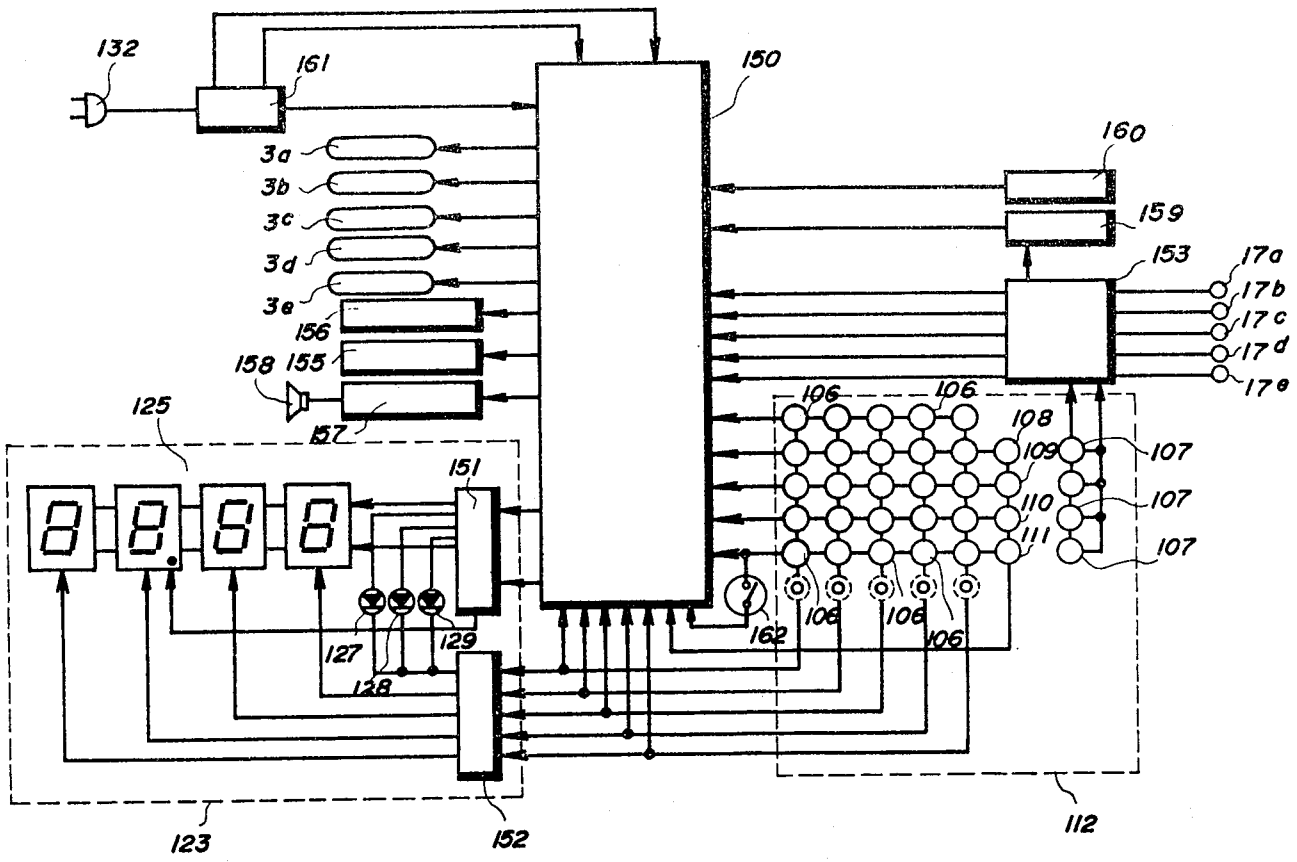
FIG. 14 is a schematic block diagram of a heating type hair waving appliance according to the teaching of the present invention.

The control circuitry of the heating type hair waving appliance will be described by reference to FIG. 14.

The control circuitry may be implemented with a single chip LSI semiconductor integrated circuit microcomputer 150 which has a 1 k bite ROM capacity with 42 pins and the following functions.

If the power switch 131 of the controller 6 is turned on, then the digital display 125 is enabled to display a zero in the least significant digit position through the window 123 by drivers 151, 152. Inputs are introduced via the duration keys 106 of the controller 6 to control individually the operation durations of the heating elements 3*a* through 3*e* corresponding to the respective hairline regions 1*a* through 1*e*. The longest duration is displayed on the digital display 125 in the window 123 by enabling the display 125 through the drivers 151, 152. In response to an input via the preheat key 10*u* the heating elements 3*a*–3*e* corresponding to the respective hairline regions are operated and the preheating operation is displayed by a blinking zero on the digital display 125. Electrical representations of the temperatures of the hairline regions 1*a* through 1*e* being heated by the devices 3*a*–3*e* are generated from the temperature sensors 17*a*–17*e* and then compared with the temperature settings by the temperature keys 107 in a comparator 153. If any hairline region 1*a*–1*e* reaches the temperature settings, then the signal from the comparator 153 permits the drivers 151, 152 to enable the preheating display 127. The completion of the preheating operation is displayed by the green light display 127. Upon the completion of the preheating operation the heating element 3*a*–3*e* are controlled to approach the temperature settings by the temperature key 107. In response to the actuation of the start key 109 the longest duration for the respective hairline regions 1*a*–1*e* is displayed on the four-digit digital display 125 and decremented in the progress of time. Simultaneously, an ultrasonic atomizer circuit 155 and a blow motor 156 are enabled. The amount of the mist to the interior of the bonnet 2 is adjusted by the mist switch 81. Upon the completion of the heating and humidifying operation, the heating elements 3*a*–3*e*, the ultrasonic atomizer circuit 155 and the fan motor 156 are disabled and the completion of the operation is displayed on the digital display 125 and audibly announced by a sound from a sound circuit 157 and a speaker 158 for a specific period of time. In the case where the 25 min operation start key 110 or the 20 min start key 111 is operated, all the regions 1*a*–1*e* are heated at the same temperature and same duration and the atomizer 4 is also operated for humidifying purposes. The 25 min or 20 min operation is visually displayed on the displays 128, 129. The progress of the 25 min or 20 min operation is displayed on the digital display 125. The operation is not carried out even upon actuation of the start keys 106, 110, 111 unless the preheating operation is completed. The sound circuit 157 enables the speaker 158 only when actuations of the respective keys 106–111 are confirmed, releasing "peep" in this case. In the event that all the heating elements 3*a*–3*e* are supplied with current at the same time, a large rush current will flow and need large capacity switching elements. For this reason the respective heating elements 3*a*–3*e* are activated in sequence to avoid the generation of such a rush current. Since the respective heating elements 3*a* through 3*e* are turned on or off when any thermistor is short circuited or opened, a comparator 159 is provided to generated an alarm sound via the sound circuit 157 and the speaker 158 when the resistance of the thermistor 37 reaches an upper limit or a lower limit. A the same time the heating elements 3*a*–3*e* are disabled immediately. The atomizer 4 is nonoperative upon the completion of the preheating operation and operative upon the actuation of the start keys 109, 110, 111. A water level sensor 160 comprising the first and second lead switches 68, 69 alarms via the sound circuit 157 and the speaker 158 that the liquid level in the reservoir 59 falls below a predetermined one, in response to the output from the first lead switch 68. The ultrasonic atomizer circuit 155 is turned off as soon as the signal is developed from the second lead switch 69. When the level in the reservoir 59 falls below the limit, a timer circuit contained within the microcomputer starts operating to indicate that the reservoir 59 is to be replenished with liquid and the atomizer circuit 155 is to be shut off. The second lead switch 69 prevents the load-free condition of the ultrasonic vibrator 71, for example, when water is forcedly discharged in operation. In this case the lead switch 69 is closed to send a signal to the microcomputer 150 and shut off immediately the atomizer circuit 155. In FIG. 14, a power supply is labeled 161 and a 50 Hz/60 Hz switch is labeled 162.

The heating type hair waving appliance according to the present invention will be operated in the following sequence.

The feed water is introduced into the feed water tank 61 which in turn is inserted into the reservoir 59. The protrusion 63 on the reservoir 59 opens the feed water valve 62 to supply the reservoir 59 with water.

The power plug 132 is connected to the utility power line and the power switch 131 is turned on. The atomizer switch 81 is manually operated to define the amount of the mist. Taking the nature of patron's hair, a desired hair style, etc. into consideration, the duration keys 106 are manually independently operated to set the heating durations for the respective hairline regions 1*a*–1*e*. The temperature keys 107 are also operated to set the heating temperatures. When the duration keys 106 are operated to set the heating durations, confirmation sounds are provided from the speaker 158 and the operative condition of the appliance is visually indicated by the zero display on the digital display 123. Upon the depression of the preheat key 108 the heating elements 3*a*–3*e* become conductive to preheat the bonnet 2. The preheating operation is indicated audibly by the sound from the speaker 158 and visually by the blinking zero display on the digital display 125. The operative conditions of the respective heating elements 3*a*–3*e* are displayed by the pilot lamps 24. The temperature during the preheating operation is sensed by the sensors 17*a*–17*e* and compared with the settings by the temperature key 107 through the comparator 153. When any temperature sensor 17*a*–17*e* finds the temperature settings reached, the microcomputer 150 receives a signal therefrom so that the digital dislay 125 changes from the blinking zero display to the non-blinking zero display. The completion of the preheating operation is displayed on the green light emitting diode 127. Such preheating operation eliminates deviations of the starting temperature within the bonnet 2 due to season, room temperature and using conditions. The heating elements 3*a*–3*e* are controlled according to the temperature settings with the aid of the microcomputer 150 after the preheating operation. Subsequently, hair in the respective hairline regions 1*a*–1*e* is covered with a waving agent and wound around curler rods 163. The hairline regions 1 of the patron is located within the bonnet 2 and the start key 109 for individual heating operations is operated.

The longest duration out of the heating duration settings by the duration keys 106 is displayed on the digital display 125 and then deremented in the progress of time. Simultaneously, the microcomputer 150 renders the atomizer circuit 155 and the fan motor 156 operative. The amount of the mist defined by the atomizer switch 81 is sent to the bonnet 2 for humidifying purposes. After the expiration of the duration setting the respective heating elements 3*a*–3*e* are disabled and an abrupt drop in temperature is shown. Desired degrees of hair waving are therefore available to the respective ones of the hairline regions. When all of the heating elements 3*a*–3*e* are disabled, the atomizer assembly 4 is also disabled to provide a zero display on the display window. The microcomputer 150 enables the sound circuit 157 and then the speaker 158 to provide a completion sound for a given period of time.

As stated above, the heating and humidifying operation is performed independently for each hairline region 1*a*–1*e* of the patron's head. In the case where all of the hairline regions 1*a*–1*e* are heated and humidified at the same temperature and for the same duration of time (in this case, the appliance device serves mainly as a steamer), the temperature key 107 on the controller housing 6 is first operated to set a desired duration of time and preheat key 108 is subsequently operated. Upon the completion of the preheating operation the preheat display 127 is enabled. Either the 25 min operation start key 110 or the 20 min operation start key 111 is selected to initiate the heating operation. Such operation is displayed on either the display 128 or 129 and the progress of the heating operation is displayed on the digital display 125.

Figure 16:
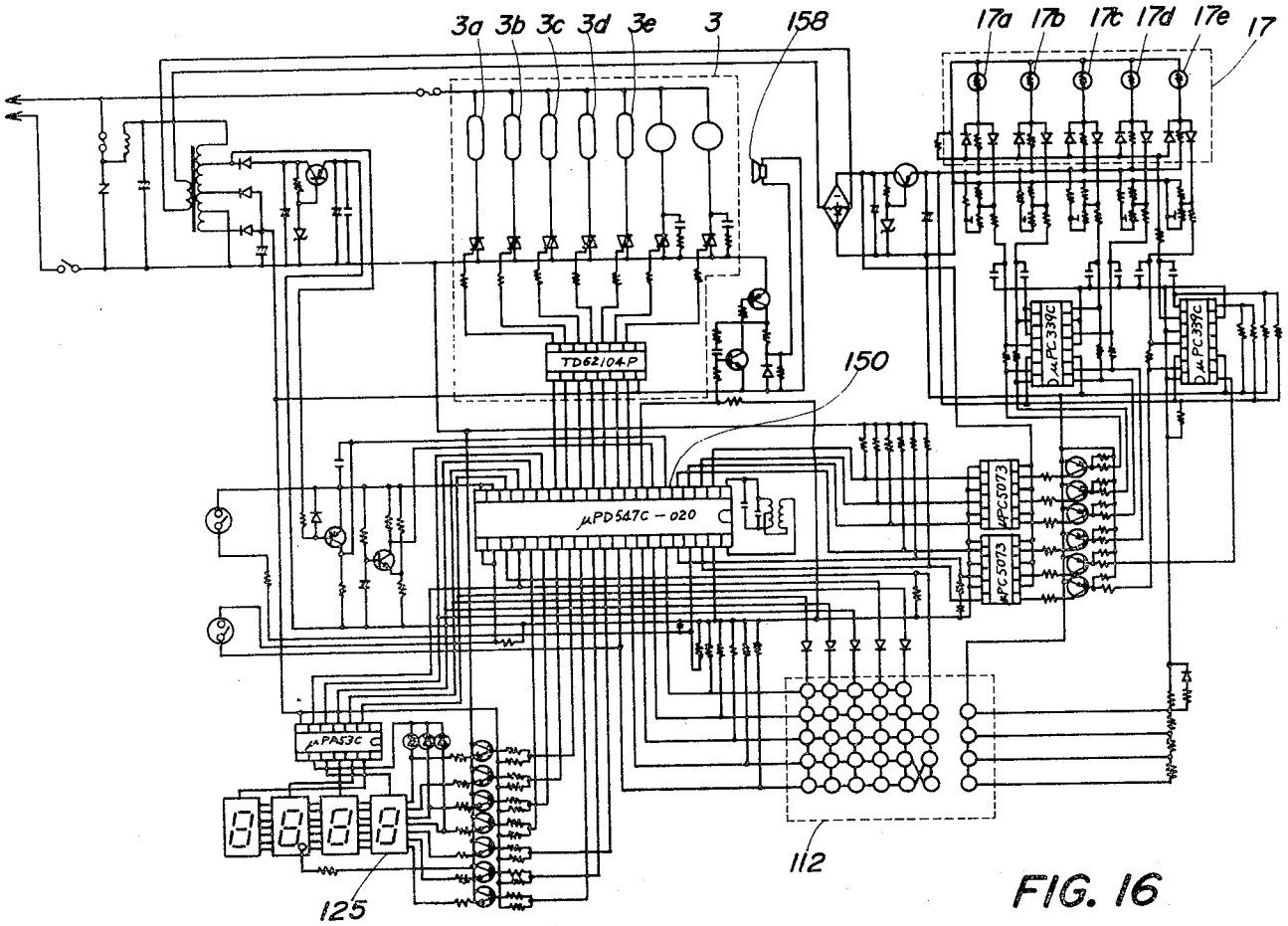
FIG. 16 is a circuit diagram of details of the control circuitry of the hair waving appliance.

FIG. 16 shows details of the control circuitry of the heating type hair waving appliance of which construction and operation are clearly understood by the reference to the foregoing disclosure.

Whereas the present invention has been described with respect to a specific embodiment thereof, it will be understood that various changes and modifications will be suggested to one skilled in the art, and it is intended to encompass such changes and modifications as fall within the scope of the appended claims.

We claim:

1. A heating type hair waving appliance for use on a patron's hairline area comprising:

a head supporting assembly;

a plurality of heating means distributed throughout the interior of said head supporting assembly for heating different hairline regions of the patron's head; and microprocessor controller means for independently controlling the operation of each of said plurality of the heating means.

2. A heating type hair waving appliance for use on a patron's hairline area comprising:

a head supporting assembly;

heating means provided within said head supporting assembly for heating the hairline area of the patron's head;

temperature sensing means for monitoring the heating temperature of the hairline area being heated by said heating means;

microprocessor controller means for controlling the operation of said heating means in response to the output of said temperature sensing means; and display means for displaying operation of said heating means.

3. A hair waving appliance for use on a patron's hairline area comprising:

a support;

a plurality of distributed heaters for independently heating different hairline regions of the patron's head;

a plurality of temperature sensors each associated with one of said distributed heaters for independently sensing the temperature of each of said different hairline regions;

microprocessor controlled means for controlling the operation of each of said heating means in response to the output of its associated temperature sensor, said microprocessor control allowing said different hairline regions to be regulated at different temperatures.

4. The appliance of claim 3 further comprising:

atomizer means for generating moisture laden air mist, said atomizer means applying moisture to the patron's hairline area;

said microprocessor controller controlling the operation of said atomizer means.

5. The appliance of claims 3 or 4 wherein said microprocessor controller means independently controls the duration of operation of each of said distributed heaters.

6. The appliance of claim 3 further comprising:

displaying means displaying information relating to the temperature and duration of operation of said distributed heaters.

7. The heating type hair waving appliance according to claim 4, further comprising means for providing an alarm when the level of liquid in said atomizer means is below a predetermined level.

8. The appliance of claim 6 wherein said display indicates the length of time said distributed heaters are the to remain actuated.

9. The appliance of claim 6 further comprising audible indicator means for indicating the completion of operation of said plurality of distributed heaters.

10. The appliance of claim 5 wherein said microprocessor includes a read only memory for storing a control program and circuitry for calculating the durations said distributed heaters are to be operated.

* * * * *